US005115995A

United States Patent [19]

Hunt

[11] Patent Number: 5,115,995

[45] Date of Patent: May 26, 1992

[54] ANGULARLY LOCKABLE PAYOUT TUBE

[75] Inventor: Rodney J. Hunt, Omaha, Nebr.

[73] Assignee: AT&T Bell Laboratories, Murray Hill, N.J.

[21] Appl. No.: 633,887

[22] Filed: Dec. 26, 1990

[51] Int. Cl.[5] ..... B65H 57/12; B65H 49/08

[52] U.S. Cl. ..... 242/157 R; 242/737.1; 242/146; 242/163; 242/171

[58] Field of Search ..... 242/157 R, 163, 170, 242/171, 159, 137, 137.1, 132, 146, 141, 129.7, 129.71, 129.72

[56] References Cited

U.S. PATENT DOCUMENTS

| | | | |
|---|---|---|---|
| 4,009,845 | 3/1977 | Santucci et al. | 242/137.1 X |
| 4,022,399 | 5/1977 | Zajac | 242/163 |
| 4,057,203 | 11/1977 | Newman et al. | 242/163 |
| 4,057,204 | 11/1977 | Zajac | 242/163 |
| 4,160,533 | 7/1979 | Kotzur et al. | 242/137.1 |
| 4,274,607 | 6/1981 | Priest | 242/163 |

*Primary Examiner*—Stanley N. Gilreath
*Attorney, Agent, or Firm*—Ruloff F. Kip

[57] ABSTRACT

The invention is for an improvement in a payout tube for container-packaged coiled wire in which the tube in use is in the container which has in a wall thereof a hole comprising a circular main aperture and a pair of notches projecting from such aperture. The tube is secured to the container by passing an end of the tube through such aperture, and radial projecting tabs on the tube at that end through such notches, so as to locate such end and tabs on the wall's outside while radially projecting lugs on the tube remain on the tube's inside, and by then angularly turning the tube to insert sections of such wall bordering such hole between such tabs and such lugs. The improvement constitutes providing on the tube a pair of movable fingers and associated resilient hinges by which those fingers are hingedly coupled to the rest of the tube. At the end of the tube's angular turning described above, such fingers lodge in the notches so as, by engaging with the side walls of the notches, to stop the tube from subsequent turning which might lead to detachment of the tube and container. One or more of such fingers and resilient hinges are disclosed as having various other uses.

13 Claims, 5 Drawing Sheets

ANGULARLY LOCKABLE PAYOUT TUBE

FIELD OF THE INVENTION

This invention relates generally to devices for dispensing a filamental article (as, say, insulated wire, stranded cable or the like) from a coil of such filament. More particularly, this invention relates to devices of such kind in which the filament is stored in a coil in turn packaged in a box or other container, and in which the dispensing device consists of a payout tube which has a stub received in a hole in a wall of the container, and which provides a passage from its inside to its outside for filament led from the coil through the tube.

BACKGROUND OF THE INVENTION

U.S. Pat. No. 4,057,204 issued Nov. 8, 1977 in the name of R. E. Zajac to Windings, Inc. ("Zajac") discloses a payout tube of the above described sort in which an annular flange encircles the tube near its exit end to provide a planar stop surface extending continuously around the tube and the tube has at such end, axially outward of the flange, on diametrically opposite sides of the tube, a pair of projections which extend radially out from the tube to lie over the flange and which are shown as being of triangular cross section in planes normal to the radial center lines of the projections. The walls of such projections towards that flange are planar and slope in opposite directions as seen in a direction along the tube diameter between those centerlines.

The Zajac tube is secured in position within the container by (a) providing in a wall of the container a circular hole of the tube's diameter and having equangularly spaced around it a pair of notches formed in the hole's circumference for receiving the tube projections, (b) positioning the tube inside the container to pass a stub portion of such tube through such hole and such projections from inside to outside through such notches until the tube flange bears against the inside of such wall around the circumferential margin of the hole, and (c) then turning the tube 90° to cause portions of the wall around the tube to be interposed between such flange and the tube projections to thereby secure the tube to the wall. According to the Zajac patent as it is understood, what happens in the course of such turning is that, because the space between the flange and the axially inner edges of the sloping projection walls towards the flange is a space less then the wall thickness of the container, the turning of the tube causes the inclined lower surfaces of the projections to ride up on the box material and grip into it to prevent accidental turning of the tube to an improper position. The Zajac patent also indicates in its abstract that improper turning of the tube is avoided because the effect of the tube projections on the box material is that the projections "dig into it".

The Zajac tube has the disadvantage that, because the space between the flange and the axially inner edges of the sloping projection is less than the thickness of the wall of the container, it is relatively difficult to initially insert portions of that wall between such flange and those inner edges. Moreover, it is thereafter very difficult (because of high friction between the wall and the tube) to relatively turn the tube and container about by 90° as taught by Zajac. Another disadvantage of the Zajac tube is that any such tube with a particular spacing between its flange and the inner edges of its projections is limited to a relatively restricted range of the thickness of container wall with which the tube can, as a practical matter, be used.

SUMMARY OF THE INVENTION

These and other disadvantages are avoided according to the invention hereof in one of its aspects by providing, for a container having in a wall thereof a hole comprising a central aperture and at least one peripheral notch, a payout tube unit comprising: a tubular sleeve having an axis and adapted for conducting the aforementioned filament therethrough, means on said sleeve for securing it to the container by advancing part of the tube through the hole in the container wall while another part of the tube remains on the same side of such wall, and by then angularly turning the tube relative to the container so as to insert axially between parts of the tube unit a pair of such wall bordering said hole, and detent means adapted in response to such turning of the tube to lodge in the notch and, by engaging with the side wall of the notch to subsequently lock the tube and container from relative angular turning which might lead to undesired casual detachment of the tube and container.

According to the invention in another of its aspects the tube unit may comprise resilient means which, whether or not capable of serving as said detent means, is adapted, when said wall section is inserted axially between said tube parts, to be resiliently strained and, on that account, to exert on the container a yieldable axial force which urges engagement between the container and one of said tube parts to the end of eliminating any play which may exist between the container and tube.

According to the invention in yet another of its aspects, the payout tube unit comprises a movable extension of the body of the tube and a resilient hinge through which such extension is hingedly coupled to the remainder of the tube, such hinged extension having various uses.

BRIEF DESCRIPTION OF THE DRAWING

For a better understanding of the invention, reference is made to the following description of an exemplary embodiment thereof, and to the accompanying drawings wherein.

In the description which follows, the term "angular" refers in a system of polar coordinates to the angular direction around the axis of payout tube. Certain features of the payout tube unit disclosed herein are also disclosed in my copending application Ser. No. 07/572,812, filed Aug. 24, 1990, and entitled "Payout Tube For Container Packaged Coiled Filament" and assigned to the assignee hereof, and incorporated herein by reference and made a part hereof.

DETAILED DESCRIPTION

Figure 1:
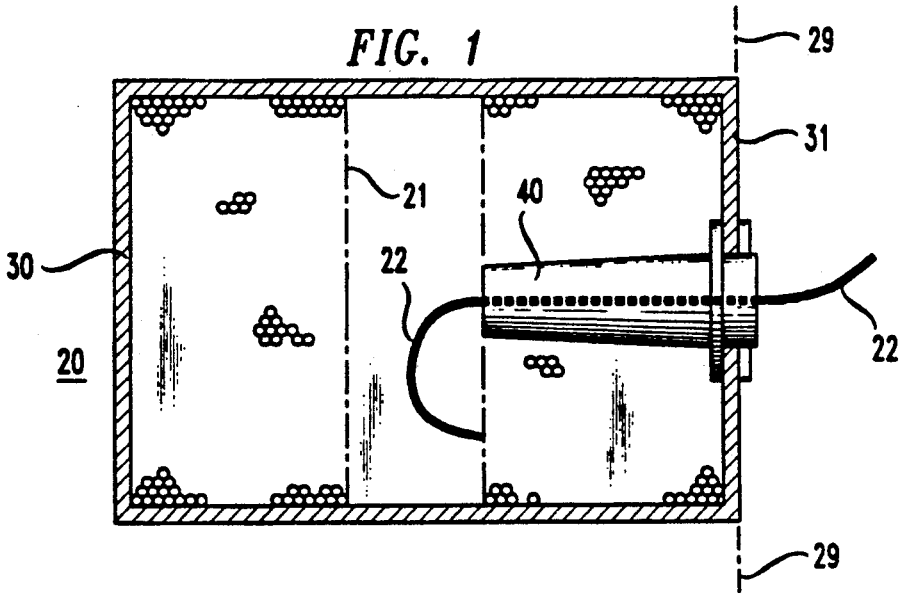
FIG. 1 is a schematic front elevational view, partly in cross-section, of the assemblage of a coil of filamental material, a container in which such coil is packaged, and a payout tube disposed in the container for dispensing from the container the filament payed out from the coil.
Figure 2:
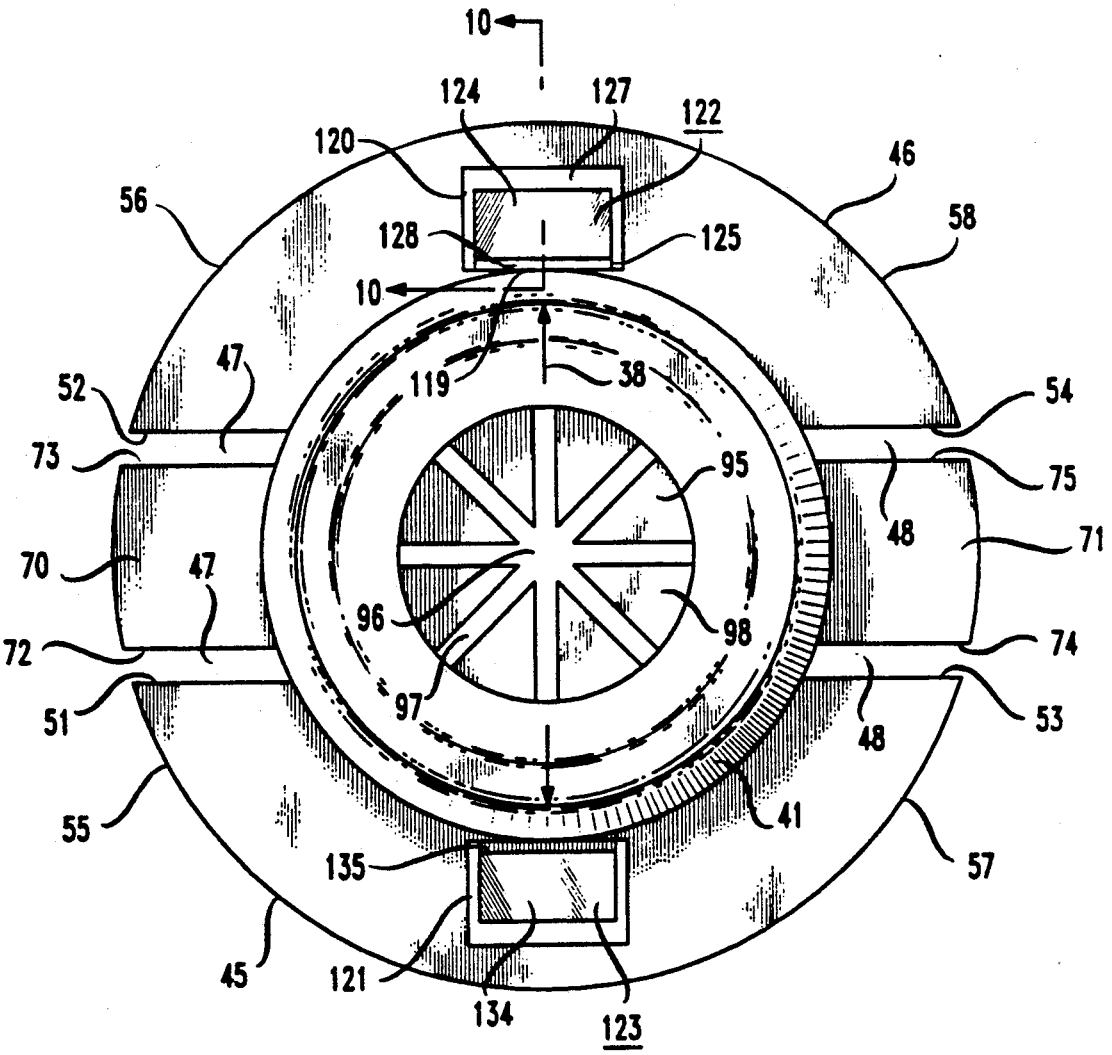
FIG. 2 is a plan view of the FIG. 1 payout tube when in upright position.

Referring now to FIG. 1, the reference number 20 designates an assembly of a coil 21 of a filamental material packaged in a container 30 in which is a payout tube unit 40 for dispensing lengths of such material from the container. A filament 22 of such material is shown as extending from coil 21 through tube 40 to the outside of container 30. The filament 22 depicted is an insulated electrical wire, but the invention is not limited for use only with such wire.

The coil 21 may comprise superposed layers of filament in figure "8" configurations in which the crossovers of the configurations in successive layers migrate around a central core for the coil. Coils of such kind are disclosed in U.S. Pat. No. 4,057,204 and U.S. Pat. No. 4,274,607.

The container 30 is in the form of a box having a square bottom and top joined by vertical rectangular side walls including a wall 31 on the right side of the box. The underformed outer surface of wall 31 defines a plane 29. The bottom, top and side walls of box 40 are constituted of corrugated or uncorrugated cardboard or fiberboard or other packaging material adapted when constituting a portion of a wall or other panel to be resiliently flexible over a useful range of deformation.

Wall 31 has formed therein (FIG. 6) a hole 32 comprising a circular main aperture 33 and a pair of supplementary apertures in the form of notches 34, 35 diametrically opposite each other around main aperture 33 and extending radially outward from the circumference of that aperture. The notches 34, 35 are bounded on their respective sides by side walls 24 and 25 provided by the material of container wall 31.

The payout tube 40 comprises (FIGS. 2-5) a molded synthetic resinous tubular sleeve 41 having an axis 39 and entrance and exit ends 42, 43 for the filament 22. Disposed at exit end 43, somewhat inward of the sleeve's exit opening 44 are two stop lugs 45, 46 integral with and disposed on diametrically opposite sides of sleeve 41 to be at opposite ends of a diameter 38 for the sleeve. The lugs 45 and 46 are, as shown, in the form of similar annular segments each having an angular extent around the sleeve of more than a quadrant but less than a semicircle. In consequence of having such disposition and form, lugs 45 and 46 are separated on transversely opposite sides of diameter 38 by the openings 47 and 48 which radially extend away from the periphery of sleeve 41 and which are notch openings in the sense that they are open to the environment of the tube at their radially outward ends. Openings 47 and 48 each provides for unblocked passage therethrough in the axial direction.

Figure 5:
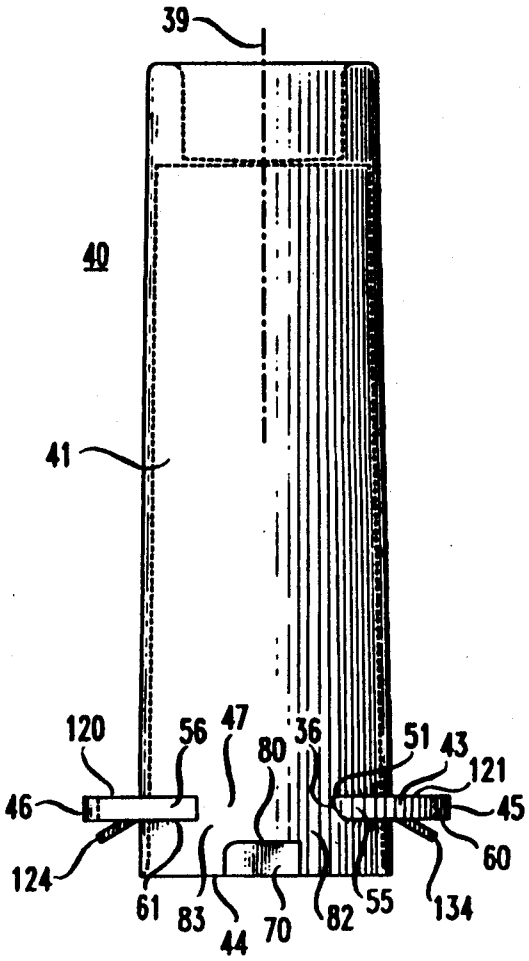
FIG. 5 is a left side elevation of the FIG. 2 tube.
Figure 4:
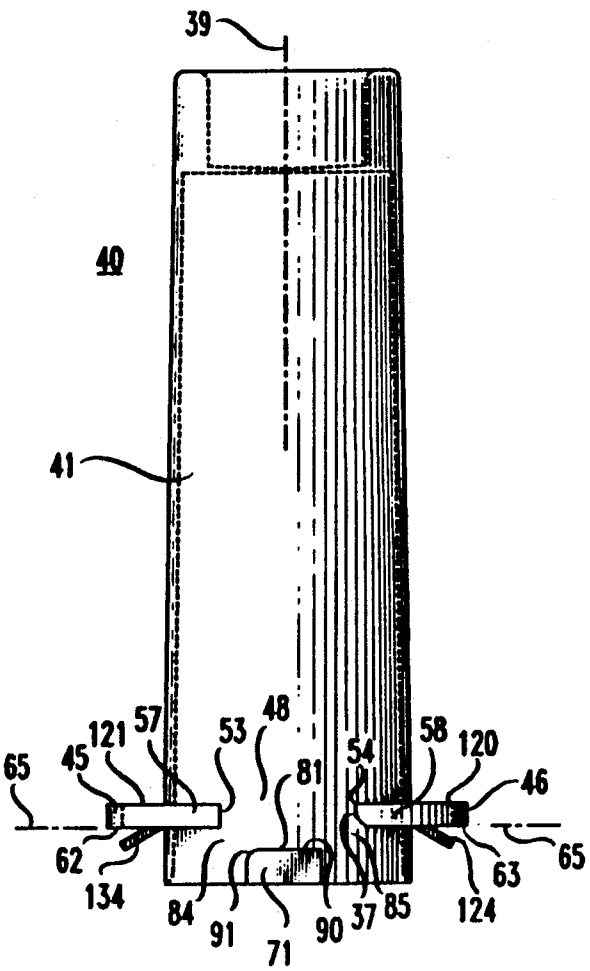
FIG. 4 is a right side elevation view of the FIG. 2 tube.
Figure 3:
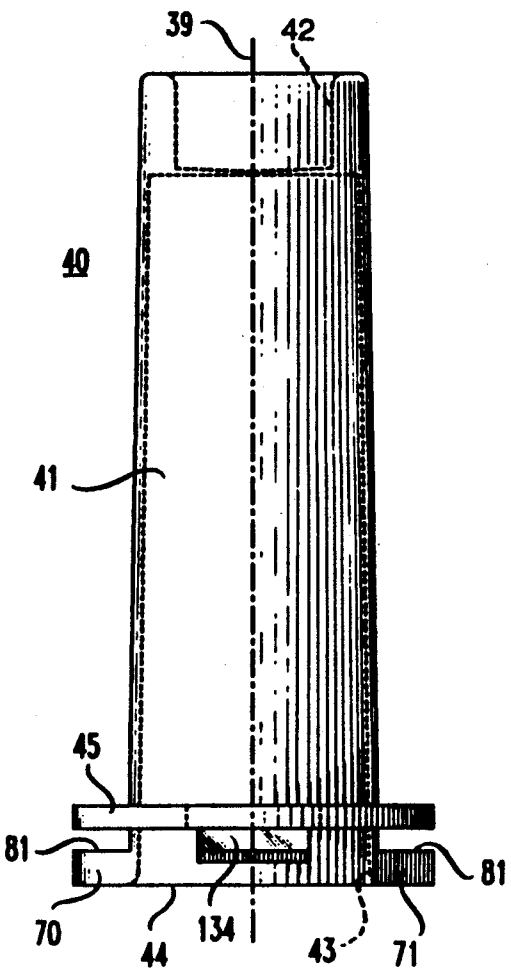
FIG. 3 is a front elevation view of the FIG. 2 tube.
Figure 8:
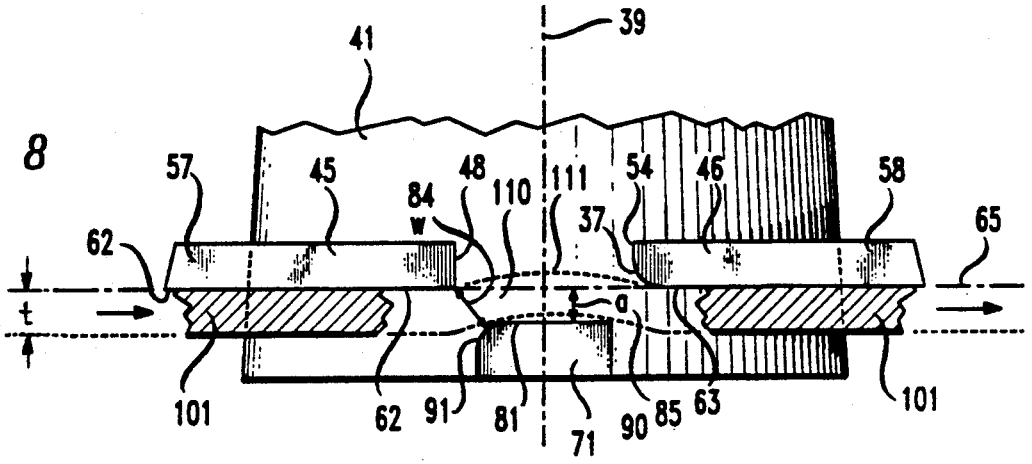
FIG. 8 is an enlarged plan view of the inserted and turned tube of FIG. 7 and of portions of the container wall (depicted in cross-section) shown in FIGS. 6 and 7.
Figure 9:
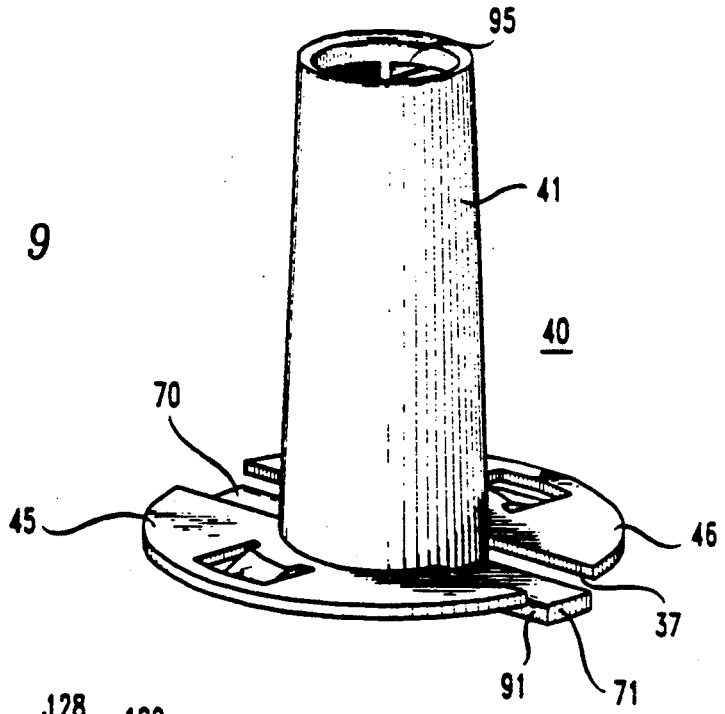
FIG. 9 is an isometric view of the FIG. 2 tube.

Considering further details of elements 45-48, the stop lugs project radially outward from the periphery of sleeve 41 in both directions of a first dimension colinear with diameter 38 and, also, in both directions of a second dimension normal to such diameter. The notch openings 47 and 48 between the lugs are bounded on angularly opposite sides of such openings by lug margins 51, 52, 53, 54 which are normal to such diameter, i.e., are aligned with said second dimension and parallel with each other. Thus openings 47 and 48 are of constant width normal to their radial centerlines. As shown in FIGS. 4, 5 and 8, the lug margins 51 and 54 have faired surfaces or cambers 36 and 37 on their undersides.

The lugs 45 and 46 provide on opposite sides of opening 47 a first pair of angularly adjacent stop portions 55 and 56 respective to those lugs. Similarly lugs 45 and 46 provide on opposite sides of opening 48 a second pair of stop portions 57 and 58 respective to the lugs 45 and 46. The stop portions 55-58 of tube 40 are so called because they are adapted in the use of tube 40 to bear against the inner side of box wall 31 to stop the tube from further movement outward through hole aperture 33.

The stop portions 55-58 have thereon respective surfaces 60-63 which are disposed on the axial side of such portions towards the exit openings 44 of sleeve 41, and which surfaces (or parts thereof) lie in and define a plane 65 (FIG. 4) normal to the axis 39 of the sleeve.

Those surfaces (or parts thereof) are adapted to bear against the inner side of wall 31 to stop tube 40 as described above. For convenience, such surfaces are referred to herein as "stop surfaces" although it does not necessarily mean that all areas of such surfaces lie in plane 65 or perform the stopping function just mentioned.

Besides the radial projections provided on sleeve 41 by lugs 45 and 46, the sleeve has thereon two additional projections in the form of axial locking tabs 70 and 71 disposed to be at angular positions corresponding to those of openings 47 and 48 and intermediate those of, respectively, the stop portions 55, 56 and the stop portions 57, 58. The tabs 70 and 71 are coupled and integral with sleeve 41 and project away from it in radially opposite directions. Tab 70 has angularly opposite margins 72, 73 adjacent and parallel to the margins 51, 52 on the lugs 45 and 46, while tab 71 has angularly opposite margins 74, 75 adjacent and parallel to the margins 53, 54 on those lugs.

In the axial direction, the tabs 70 and 71 are disposed on sleeve 41 outward of the lugs 45 and 46 to be axially opposite the interlug openings 47, 48, but the tabs are not further out than the sleeve's exit opening 44. The tabs have thereon respective guide surfaces 80 and 81 facing in the axial direction towards the entrance end of the sleeve and axially displaced from the plane 65. The guide surface 80 of tab 70 is separated by gaps 82 and 83 from, respectively, the stop surface 60 on lug 45 and the stop surface 61 on lug 46. Similarly the guide surface 81 on tab 71 is separated by gaps 84 and 85 from, respectively, the stop surface 62 on lug 45 and the stop surface 63 on lug 46.

The guide surface 81 on tab 71 (FIG. 4) consists for the most part of a flat land 90 lying parallel to plane 65. That surface also includes, however, at the left hand margin 74 of tab 71 a rounded surface area 91 providing at that margin a camber for tab 71. The guide surface 80 of tab 70 is similarly shaped (FIG. 5) to consist for the most part of a flat land parallel to plane 65 but to include also at its margin 73 a rounded surface area providing at such margin a camber for tab 70.

The interior of sleeve 41 contains at the sleeve's entrance end 42 a diaphragm 95 (FIG. 2) integral with the sleeve and extending across such interior. The diaphragm is perforated at its center by an axial aperture 96 of slightly smaller diameter than filament 22 and at the center of a "star" configuration formed of a plurality of slits 97 equangularly distributed around hole 96 and radially extending outward from it. The slits 97 divide the area of diaphragm 95 adjacent aperture 96 into resiliently deflectable fingers 98 which, as later explained in more detail, are operable to impose on filament 22 a limited force opposing reversal in the motion of the filament.

Figure 10:
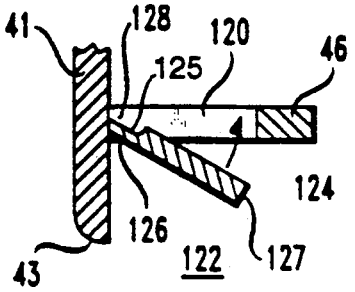
FIG. 10 is an enlarged fragmentary right elevational cross-sectional view, taken as indicated by the arrows 10—10 in FIG. 2 of a detail of the FIG. 2 tube.

Formed in, respectively, the stop lugs 46 and 45 are two windows 120 and 121 passing axially through those top lugs and of rectangular shape, the larger dimension of the rectangle defined by each window being in the angular direction of the tube. The two windows 120 and 121 respectively contain two resilient means 122 and 123 integral with and coupled to the remainder of tube 40 to be constituted of the same synthetic resinous material as that tube. As well shown by FIGS. 2 and 10, the resilient means 122 comprises a rectangular finger 124 received within window 121 and a resilient hinge 125 through which the finger 124 is hingedly coupled to the radially inner side 119 of window 120 and, hence, to the remainder of tube 40. Finger 124 constitutes a movable extension of that tube.

The finger 124 is of similar rectangular shape to window 120. It is, however, smaller in size than that window and is disposed to fit within it with clearance all around except where the finger is joined to window side 119 by hinge 125. As a result, the finger 124 is deflectable up and down in the axial direction about a pivot provided by the hinge 125. As well shown by FIG. 10, such axially deflectable finger or pivoted "beam" 124 radially extends from coupled end 126 thereof at hinge 125 to a free end 127 of the finger. If desired, hinge 125 may be located at the radially outer side of window 120.

The resilient hinge 125 is created in part by forming on the upper side of stop lug 46 at the juncture of the finger 124 and the window side 119, a groove 128 which decreases at that juncture the axial thickness of the synthetic resinous material constituting the resilient means 122. Groove 128 extends in the angular direction of tube 40 for the full length of finger 124. The depth of groove 128 may be varied as desired to increase the resilient pliancy of the hinge 125 directly as the groove depth increases. Thus the free end 127 of finger 124 may be deflected upward (FIG. 10) a specified distance by application thereto of a substantially smaller axial force than would be required to deflect it up the same distance if notch 128 were not so present. The finger 124, hinge 125, and notch 128 are formed when tube 40 is being fabricated by molding so that, for the resiliently unstrained condition of hinge 125, the free end 127 of the finger 124 is displaced outward (FIG. 10) from the stop lug 46 to project from that lug in the axial direction towards locking tabs 70 and 71.

The resilient means 123 contained within window 121 is joined to the radially inner side 118 of that window and comprises a finger 134 and a resilient hinge 135 through which the finger 134 is hingedly coupled to the remainder of tube 40. The elements 134, 135 are counterparts of the elements 124, 125 of the resilient means 122 in the window 120. Accordingly, the above description of the elements of means 122 is also applicable to the elements of means 123.

USE OF THE EMBODIMENT

Figure 6:
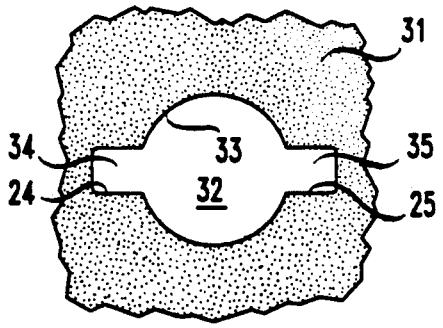
FIG. 6 is an enlarged fragmentary right side elevation view of the FIG. 1 container showing an outlet hole made in a wall of such container for the payout tube shown in FIGS. 1–5.
Figure 7:
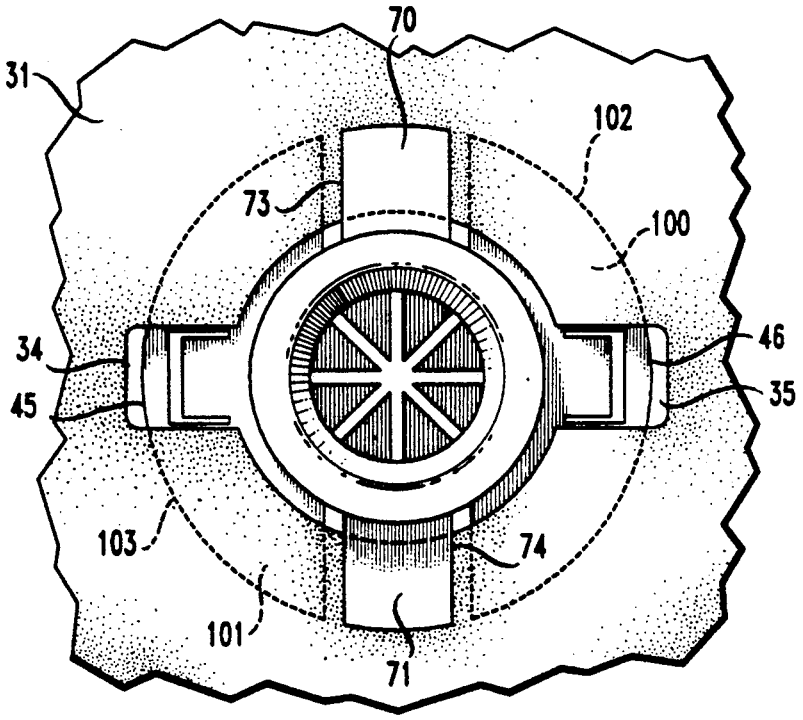
FIG. 7 is a view of the mentioned hole similar to that of FIG. 6 but showing in addition the mentioned tube of FIGS. 1–5 after it has been inserted into and then turned 90° in the FIG. 6 hole.

The manner in which payout tube 41 is secured to container 30 is shown by FIGS. 6–8 and is as follows. With the tube being in the container, the tube is axially aligned with aperture 32 in the container's wall 31 and is then rotated about its axis to bring the tube tabs 71 and 70 into respective angular alignments with the notches 34 and 35 of the hole 32 through container wall 31, the camber 91 on the tab being on its downside when the tab is so angularly aligned. The tube is then advanced towards container wall 31 to pass tab 71 through notch 34 and to pass tab 70 through notch 35. The advance in that direction of the tube is stopped by the coming into contact of the stop surfaces 60–63 on the tube's stop lugs 45, 46 with the inside surface of the box wall 31. As best shown in FIG. 6, the notches 34 and 35 through which the tabs 71 and 70 are passed may have radial lengths greater by more than a clearance than the radial lengths of such tabs.

Having passed the locking tabs 70 and 71 of tube 40 to the outside of box wall 31 and produced engagement between the stop surfaces of that tube and the inside of such wall, the tube is next turned counterclockwise (FIG. 6) about its axis through an angular arc which ultimately reaches 90°. The results of such turning is depicted in FIGS. 7 and 8. At the beginning of the turning, the cambers on the tabs 70 and 71 engage the adjacent margins of the notches 35 and 34 to deflect inwards (i.e., towards the center of box 30) two sections 100 and 101 of box wall 31 which border hole 32, and the areas occupied by which are indicated very approximately in FIG. 7 by the dash lines 102 and 103. These wall sections can be conveniently regarded for analysis purposes as constituting resiliently bendable beams which have base ends at the outer ends of notches 34, 35, terminate in free ends at the circumference of aperture 33, and are held to the expanse of wall 31 at their base ends and at their sides away from notches 34, 35. Increasing the radial lengths of such notches will, of course, increase the lengths of such beams and thereby decrease their stiffness to resist deflection.

After such deflection of sections 101 and 102 commences, what happens thereafter is shown in FIG. 8 for tab 71 and the wall section 101 with which that tab interacts. To wit, the tab 71 and the stop portions 57, 58 of the lugs 45 and 46 define a passage 110 which is indicated in FIG. 7 by dash lines and which angularly extends into the gap 84 between tab 71 and lug 45, then by that tab and then out of the gap 85 between tab 71 and the lug 46. The passage 110 is for relative movement therethrough of the otherwise stationary wall section 101. The passage is bound over part of the extent of such movement, on transversely opposite sides of the line of such movement by, respectively, the stop surfaces 62, 63 on the lugs 45, 46 and the guide surface 81 on tab 71. In however, the span of the passage 110 across the opening 48 between lugs 45 and 46, it is bound on only one such side by the guide surface 81 on the tab. As shown in FIG. 8, the passage 110 has, in the extent of such movement, an inflection 111 which is concave as viewed in the axial direction towards the entrance end 42 of sleeve 41, and which inflection is next to guide surface 81 and spans opening 48.

As tube 40 is first turned counterclockwise after tab 71 has, as described, been displaced through wall notch 34 to the outside of wall 31, the camber 91 on the tab diverts into the gap 84 of passage 110 the leading edge of wall section 101 which (if of a certain thickness) is resiliently bent in the course of such diversion to follow the curvature of the inflection 111 in the passage. Such bending places the wall section under resilient stress which, as such leading edge passes the right hand margin 75 of tab 71, tends to deflect the part of wall section 101 at such edge back to its original unstrained position to promote the emergence of such edge out from behind tab 71 through the gap 85 of passage 110.

Also, such leading edge of wall section is, upon contacting the rounded surface or camber 37 on the underside of margin 54 of lug 46, deflected and diverted by that camber in the axial direction towards the exit of tube 41 to promote emergence of such leading edge out of gap 85. Once that edge has so emerged, the turning of tube 40 and the consequent relative movement of wall section 110 through passage 110 is continued until the tab 71 has been angularly turned through 90° to reach its position shown in FIG. 7. When the tab is at that position, the interposition between the parts of tube 40 constituting tab 71 and stop lugs 45, 46 of a portion of box wall substantially displaced from both of notches 34 and 35 inhibits movement of tube 40 relative to box wall 31 in either axial direction. Further, reverse turning of the tab 71 to return to notch 34 and thus be positioned to regress through it may, if desired, be impeded by the existence between the tab 71 and wall section 101 of friction which is enhanced by the fact that such section in moving through passage 110 has been resilently stressed to exert axial force on the tab as a result of such stress. The cooperation of the lugs 45, 46 and the tab 71, therefore, serves to at least axially lock the tube 40 in secured relation to container wall 31.

The cooperation of tab 71 and stop portions 57 and 58 on the lugs 45 and 46 is capable alone of securing tube 40 to container 30. The use, however, of tabs 71 and 70 together makes such securing more reliable. Tab 70 and stop portions 55, 56 define for wall section 100 a passage similar to the passage 110 just described, and that tab and stop portions interact with section 100 in the same way as elements 71, 57, 58 do with wall section 101 to contribute to axially locking tube 40 to container 30.

The passage 110 has a width w which is transverse to the centerline of that passage, and of which the minimum size or value is greater than the minimum value of the axial displacement a of the guide surface 81 on tab 71 from the plane 65 defined by the (or parts of the) stop surfaces on stop portions 57 and 58. That minimum size of such width of the passage 110 occurs within one or both of the gaps 84 and 85 of the passage. Within a central region of notch opening 48 between the stop lugs 45 and 46, such transverse width of the passage 110 is not definitely fixed.

The minimum value of the width w of passage 110 should preferably be not less than the value of the thickness t of the box wall 31 in order not to make it unduly difficult for the wall section 101 to be advanced through the passage. On the other hand, such thickness t may be made less than the minimum size for width w down to a value for t exactly or about the value of or less than the axial displacement a of tab 71 from plane 65. When such thickness t is at or less than that value a, the wall section 101 may be relatively advanced through passage 110 without any significant bending of that section.

Before or after the payout tube 40 is secured, as described to the wall 31 of the container, the free end of filament 22 is positioned at the tube's entrance end 42, next moved forward through central aperture 96 of diaphragm 95, and then moved through the length of the tube to emerge from its exit opening 44 and extend for a distance beyond it. Diaphragm 95 is adapted to act as a filament restraining means as follows. The greater diameter of filament 22 than that of aperture 96 causes the diaphragm fingers 98 to be resiliently deflected radially outwards and, concurrently, the drag of the moving filament on the fingers causes them to be deflected axially forward. Such fingers remain so deflected while such filament's forward movement continues and when it stops. If the filament thereafter experiences an active force acting to the left of diaphragm 95 (FIG. 1) to tend to pull the filament rearward through the diaphragm, the frictional contact of fingers 98 with the filament and the described deflection of such fingers will cooperate to impart to the filament a counterforce which (a) opposes such active force to restrain rearward filament movement so long as the active force does not exceed an upper limit value, but which (b) will yield, of such force does exceed such value, to permit such rearward motion. It will be evident from what has been said that diaphragm 95 is capable of acting bidirectionally to provide such limited restraining effect.

Figure 11:
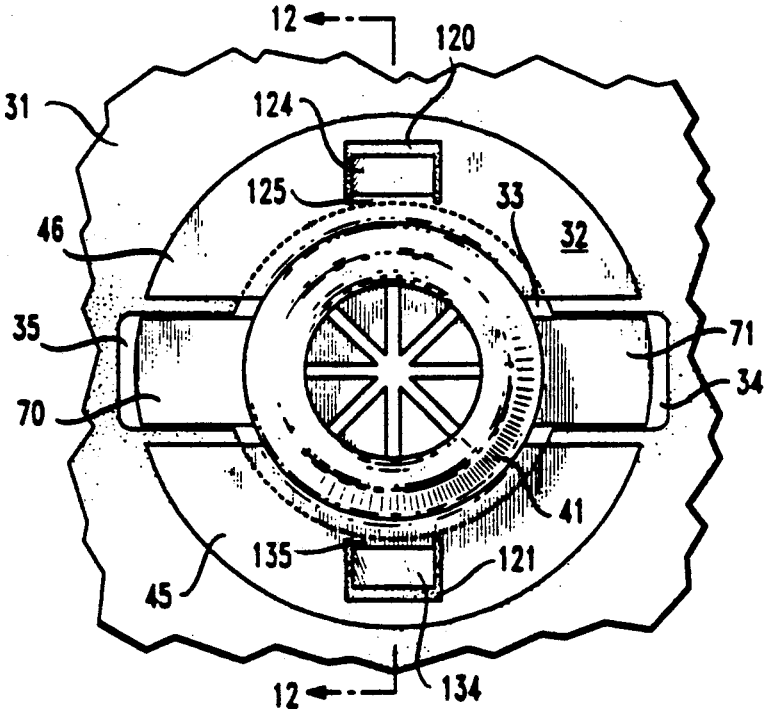
FIG. 11 is a left side elevation view, from the inside of the FIG. 1 container and tube, looking towards the container's right hand a wall at a time when the axial locking tabs on the payout tube have just been passed from the container's inside to its outside through the notches of the hole in the container.

Consideration will now be given to what happens to the resilient means 122 and 123 on tube 40 in the course of securing the tube to container 30. As earlier described, the tube 40 when in container 30 is adjusted in relation to the hole 32 in container wall 31 to align the respective axes of the tube and the hole and to angularly align the tube tabs 71 and 70 with, respectively, the notches 34 and 35 of the hole. FIG. 11 shows such alignment of the tube 40 with the hole 32.

Figure 12:
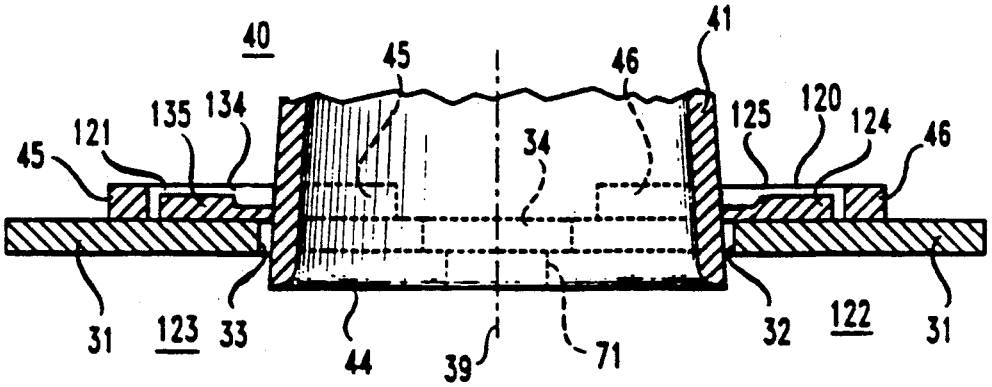
FIG. 12 is a fragmentary right hand elevational cross-sectional view, taken as indicated by the arrow 12—12 in FIG. 11, of the container and payout tube when in the condition depicted in FIG. 11.

Having attained such alignment, and with the exit end 43 of the tube being spaced a short distance away from the inner side of container wall 31, the tube is advanced towards the wall to the end of passing tabs 70, 71 through notches 34, 35 so as to position those tabs on the wall's outer side. At the start of such advance, the resilient hinges 125, 135 of the resilient means 122, 123 in windows 120, 121 are not under any resilient strain. As a result, the fingers 124, 134 of those two means are initially held by such hinges at an angle to the plane of the stop lugs 45, 46 so that the free ends of those fingers project outward from those lugs in the axial direction towards tabs 70, 71. In, however, the course of such advance, the fingers 124, 134 contact the inner side of container wall 31. The fingers are then deflected by such contact around their hinges 125, 135 as the advance continues until stopped by the engaging of lugs 45, 46 with wall 31. As of the occurrence of such stop, the fingers 124, 134 have become deflected by such contact to the position shown in FIG. 12 at which they are parallel to and make flush contact with wall 31. Further, such deflecting has resiliently strained the hinges 125, 135 for those fingers and such resilient strain in turn causes such fingers to press with yieldable axial force against wall 31. That force is directed to cause a reactive pushing away of tube 40 from the inner side of wall 31 to thereby urge the tabs 70, 71 of the tube into engagement with the outer side of such wall.

Figure 13:
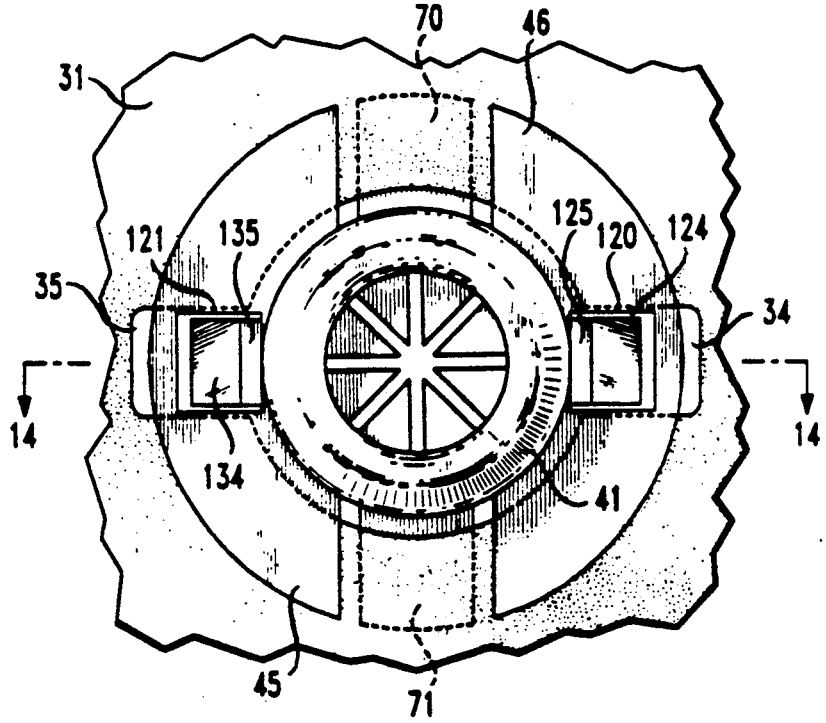
FIG. 13 is left side elevational view similar in respects to that depicted in FIG. 11, but with the tube being turned 90° relative to the container from the relative positioning of those elements depicted in FIG. 11.

Upon completion of the mentioned advance, the tube 40 and container 30 are, as stated, relatively turned to insert (FIG. 8) the wall portion 101 between tab 71 and the lugs 45, 46 and the wall portion 102 between tab 70 and those lugs, such turning being counterclockwise for the tube as viewed in FIG. 8 and clockwise for the tube as viewed in FIGS. 11 and 13. The relative angular turning of the tube and container brings the windows 120 and 121 closer and closer into registration within the notches 34 and 35 of the container hole 32 until, at a point where the full contemplated ninety (90) degree angular displacement between the tube and container has almost been reached, the contact fingers 124 and 134 in the windows clear the respective side walls 24 and 25 of the notches 34 and 35 of the hole.

As soon as such clearance occurs, the fingers 124, 134 are released from their contacts with container wall 31 and, accordingly, are driven by the resilient strains then existing in their hinges 125, 135 to be returned to their original condition. That condition is, it will be recalled, when those hinges are unstrained and the fingers project out from lugs 45, 46 in the axial direction towards tabs 70, 71. The tube and container may then be relatively turned slightly more to fully center the windows within the notches as shown in FIG. 13.

Figure 14:
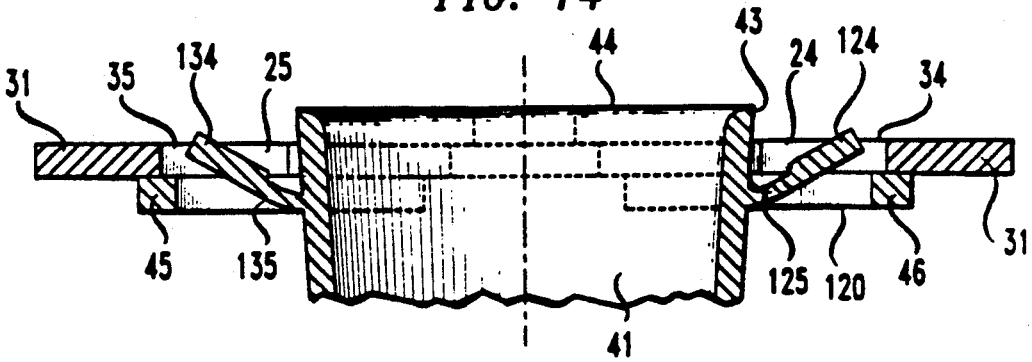
FIG. 14 is a fragmentary plan view in cross-section, taken as indicated by the arrows 14—14 in FIG. 13 of the tube and container when in the condition depicted in FIG. 13.

FIG. 14 depicts the condition just mentioned. As shown by that figure, the projecting fingers 124, 134 are now in the path of angular movement which would be followed by the side walls 24 and 25 of the container notches 34, 35 in the event of subsequent relative angular turning of the tube 40 and container 30. Hence, with the exception of a small amount of angular play which may occur between elements 30 and 40 in either angular direction (such play being possible because the fingers 124, 134 extend over slightly smaller angular intervals than do the notches 34, 35), any subsequent relative angular movement in either direction of the tube and container will bring the fingers 124, 134 into contact with the notch side walls 24 and 25 so as, by such contact, to provide a positive stop to such movement. Such positive stop contrasts with the earlier described mere drag against such movement provided by friction by wall 31 and tube 40, or by the earlier described bending of the sections 100, 101 of that wall.

The resilient means 122, 123 (comprising the fingers 124, 134 and their resilient hinges 125, 135) accordingly each serves as a detent means which locks the tube and container against such movement. When the tube is so locked, it cannot ordinarily be turned to bring its tabs 70, 71 again into registration with the notches 34, 35 to enable such tabs to regress through those notches and thereby detach the tube from the container. Hence, once the container and tube have been secured as described above, their angular locking by the means 122, 123 prevents them from becoming inadvertently or casually detached. Indeed, they cannot even be deliberately detached unless extraordinary measures are taken to entirely remove from the notches 34, 35 the fingers 124, 125.

It will be noted that the prevention just described of such detachment is in no way dependent upon either the earlier described existence of friction between tube 40 and container wall 31 or the earlier described bending of the wall sections 100, 101 to follow the inflections in the passages therefor defined between the lugs 45, 46 and the tabs 70, 71. The use of the described resilient angular locking means 122, 123 provides, therefore, the advantage that non-detachment of the tube and container is ordinarily assured while consonantly the thickness t of the container wall 31 may be made substantially less than the axial displacement a of tabs 70 and 71 from the plane 65 of lugs 45, 46. The advantage in so doing is that the initial securing of the tube and container by their relative turning is much facilitated in that such turning will not be accompanied by large friction generated between them and will not require any bending of the wall sections 100 and 101.

Another advantage provided by such locking means 122, 123 is that they adapt the tube 40 for use with a wide range of sizes for the thickness of the wall 31 of container 30. That is, such thickness may not only have certain values greater than a but, also and preferably may have any value less than a which is suitable for the container. From this it follows that a tube 40 of particular design which is equipped with the locking means 122, 123 may be used with a variety of containers differing from each other in wall thickness.

Some modifications, without restriction, within the invention hereof of the exemplary embodiment described above are as follows.

The desired angular locking effect may be realized by the use of only one of the locking means 122, 123. Such locking means need not be contained within windows formed in stop lugs 45, 46 as herein described but, rather, may be carried on by the tube sleeve 41 in separated relation from an axial stop means on the sleeve (e.g., the lugs 45, 46 and the tabs 70, 71) and may, when the tube is secured to the container, be either on the inside or the outside of the latter. Moreover, the locking means may be disposed around the periphery of tube sleeve 41 at any angular position at which they do not angularly overlap with the tabs 70, 71. The described means 122, 123 when used to effect angular locking need not be seated in the aperturing constituting the notches formed in container wall 31 to permit passage therethrough of the tube tabs 70, 71. Instead such means 122, 123 may provide such effect by being seated in other notches in such wall or, indeed, in perforations or other aperturing formed in such wall not constituting one or more notches.

The described resilient means 122, 123 has uses other than to provide the mentioned angular locking effect. To wit, such means when not in registration with perforations through container wall 31 are, as described in connection with FIG. 12, adapted to be deflected by contact with wall 31 to exert on a surface on that wall a yieldable force urging the wall and the tube towards engagement with each other. The ability of the resilient means 122, 123 to exert such yieldable force on the container wall may be employed towards various useful ends. Thus, for example without restriction, the tube 40 may be equipped with a plurality of such resilient means of which one or more are used to provide the described angular locking effect and one or more are used to "push" against the container wall to take up axial play between it and the tube in the instance where the thickness t of the wall is less than the axial spacing a of tabs 70, 71 from the plane 65 of lugs 45, 46.

The resilient means 122, 123 have been described above as comprising a substantially rigid finger or "beam" and a resilient hinge through which such finger or beam is hingedly coupled to the remainder of tube 40. The means 122, 123 can take other forms, as, for example without restriction, each comprising a cantilever beam which is fixedly coupled at its base end to the tube sleeve, and which is resiliently deflectable over its length from its base end to its free end. The provision of such resilient means 122, 123 by a hingedly coupled finger and a resilient hinge as described above is, however, particularly advantageous because it overcomes a dilemma previously encountered in payout tubes that, if a stop flange or other tube part is made thin enough to be acceptably pliant in resilient deflection, it is not strong enough to resist being damaged in use, and conversely. By, however, incorporating one or more resiliently hinged parts into a payout tube, the tube designer can, in a sense, "have his (or her) cake and eat it too" in that the resiliently hinged parts can be made as resiliently pliant as desired to accomplish the use intended therefor (by, as described above, varying the depth of the groove forming the resilient hinges therefor) while parts of the tube performing other functions can be kept stiff to remain strong. Because such movable extension-resilient hinge parts do overcome the mentioned dilemma, they are susceptible to having a variety of applications in use in payout tubes or other articles.

In the described embodiment, the radial lie of the fingers 124, 134, between their hingedly coupled ends and free ends, is advantageous because, while their resilient hinges permits those fingers to be deflected around such hinges by relatively small force, the angular lie of the hinges (resulting from the radial lie of the fingers) makes the hinges relatively strong to resist angularly directed torque forces exerted on the fingers in the event it is attempted to turn tube 40 relative to container 30 once those fingers have lodged in notches 34, 35.

The above described embodiment being exemplary only, additions thereto, omissions therefrom, and modifications thereof may be made without departing from the spirit of the invention. For example without restriction, in applications of the invention the tube unit need not be a single piece article but may be an assemblage in which one or more parts are non-integral with the remainder of the unit. As another example without restriction, the tube unit may, in applications of the invention, be disposed outside of the container instead of inside it.

Accordingly, the invention is not to be considered as limited save as is consonant with the recitals of the following claims.

I claim:

1. A payout tube for a filament disposed in a coil in a container having a wall in which is formed a hole used for said tube and comprising a central aperture and notch means extending radially outward from such aperture, said tube comprising:

a tubular sleeve having an axis and adapted for conducting said filament therethrough; stop means projecting at one end of said sleeve radially away from its periphery, at least one axial locking tab projecting at said end radially away from said periphery and axially spaced from said stop means to provide between them a passage for relative angular movement therein of a section of said wall adjacent said hole, said tube being securable to said container by advancing said sleeve end and tab through said aperture and notch means, respectively, to pass them from one side to the other of said wall while said stop means remains on the same side of said wall, and by then moving said section into and in said passage by angularly moving said tube relative to said container through an angular displacement at least enough to insert said wall section between said stop means and tab, and detent means disposed on said tube and adapted in response to said turning of said tube to lodge in said notch means and, by engaging the side wall of said notch means, to stop said tube and container from subsequent relative angular turning.

2. A payout tube according to claim 1 in which said detent means comprises resilient means adapted to contact a surface on said container wall and be resiliently strained thereby upon said advancing of said sleeve end through said hole, and to be subsequently released from said contact in the course of such angular moving of said tube, so as to return to unstrained condition and thereby become lodged in such notch means.

3. A payout tube according to claim 2 in which said tube is a molded synthetic resinous article, and said resilient means is an integral part of, and is constituted of the synthetic resinous material of, said tube.

4. A payout tube according to claim 3 in which said resilient means comprises a movable extension of said tube and a resilient hinge through which such extension is hingedly coupled to the remainder of said tube.

5. A payout tube according to claim 4 in which said stop means is an integral part of said tube and has formed therein a window extending axially therethrough, and in which said extension is a contact finger received in said window to be axially deflectable therein and having first and second ends of which the first is joined by said hinge to said stop means at one side of said window, and, of which the second end is a free end which, when such finger is undeflected, is disposed axially outward of said stop means towards said tube.

6. A payout tube according to claim 5 in which said resilient finger extends from said first end thereof to said second end thereof in the radial direction of said tube.

7. A payout tube according to claim 2 in which said resilient means has a first end coupled to the remainder of said tube and a second end which is freely deflectable in relation to such first end, and in which said resilient means extends between said first and second ends in the radial direction of said tube.

8. A payout tube according to claim 1 in which said notch means comprises at least one notch through which said tab is so advanced from one side to the other of said container wall, and in which said detent means is angularly disposed in such tube to become lodged in that one notch in the course of said angular moving of said tube.

9. A payout tube according to claim 1 in which said detent means is angularly displaced around said sleeve from said tab in non-overlapping relation with the angular interval occupied by said tab around the periphery of said sleeve.

10. A payout tube for a filament disposed in a coil in a container having a wall in which is formed an outlet hole for use with said tube and comprising a central aperture and a pair of notches disposed on diametrally opposite sides of, and extending radially outward from, such aperture, said tube comprising:

a tubular sleeve having an axis and adapted for conducting said filament therethrough, a pair of stop lugs disposed at one end of said sleeve on diametrally opposite sides thereof to radially project away therefrom, said lugs being angularly spaced from each other around said sleeve by two openings on diametrally opposite sides of said sleeve and radially extending away therefrom, at least a first of said lugs having formed therein a window extending axially therethrough, a pair of axial locking tabs radially projecting at said end of said sleeve away from the periphery thereof and angularly disposed around said sleeve to be at the angular positions of, respectively, one and the other of said openings, said tabs being axially spaced from said lugs to provide in the axial spacing between said lugs and tabs two passages respective to said tabs and adapted for relative angular movements therein of two respectively corresponding sections of said wall bordering said hole, said tube being securable to said container by advancing said sleeve end and tabs through, respectively, said hole's central aperture and said two notches to pass said end and tabs from one side to the other of said wall while said lugs remain on the same side of said wall, and by then moving each of said wall sections into and in the corresponding one of said passages by angularly moving said tube relative to said container through an angular displacement enough at least to insert each of said wall sections between the corresponding tab and portions across such passage of said two lugs, and resiliently deformable radially extending detent means received in said window of said first lug to be axially deflectable within said window, said detent means having first and second radially spaced ends of which the first is coupled to said first lug at one side of said window, and of which the second end is a free end positioned when undeflected outward of said first lug in the axial direction from such lug towards said tabs, said detent means being adapted in response to said angular moving of said tube to lodge in one of said notches and, by engaging the side wall of that notch to stop said tube and container from subsequent relative angular turning.

11. A payout tube according to claim 10 in which the second of said lugs has formed therein a window extending axially therethrough, and in which said aforementioned detent means is the first of a pair of such detent means of which the second is received in said second window and is similar in structure and disposition to said first detent means.

12. A payout tube unit for a filament disposed in a coil in a container having a wall in which is formed a hole used for said tube unit, said tube unit comprising:

a tubular sleeve having an axis and adapted for conducting said filament therethrough, means on said sleeve for securing it to said container by advancing part of said tube unit at one end of said sleeve through said hole to pass said part from one to the other side of said wall while another part of said tube unit remains on the same side of said wall, and by then angularly moving said tube unit relative to said container, and detent means on said sleeve and adapted in response to said relative moving of said tube unit to lodge in aperturing in said wall and, by engaging the side of such aperturing, to positively stop said tube unit and container from subsequent relative angular turning.

13. A payout tube unit for a filament disposed in a coil in a container having a wall in which is formed a hole used for such tube unit, said tube unit comprising:

a tubular sleeve adapted for conducting said filament through said sleeve and having an axis and a sleeve end adapted to be passed through said hole, said sleeve having thereon at said end first and second parts adapted when said end is so passed to be on one and the other side of a region of said wall bordering said hole so as to have said wall region axially disposed between such parts, said first and second parts being adapted by contacting said wall to limit relative movement between said sleeve and container in, respectively, one and other of the directions in the axial dimension of said sleeve, and resilient means disposed at said end of said sleeve and adapted to contact said container and thereupon be resiliently strained to exert on said container a yieldable axial force urging engagement between said container and at least one of said parts.

* * * * *